US010026351B2

(12) United States Patent
Kim et al.

(10) Patent No.: US 10,026,351 B2
(45) Date of Patent: Jul. 17, 2018

(54) TIMING CONTROLLER AND DISPLAY APPARATUS INCLUDING THE SAME

(71) Applicant: Samsung Display Co., LTD., Yongin, Gyeonggi-Do (KR)

(72) Inventors: Min-Je Kim, Suwon-si (KR); Won-Bok Lee, Seongnam-si (KR); Jae-Hyoung Park, Suwon-si (KR); Ki-Tae Yoon, Seoul (KR); Jae-Gwan Jeon, Incheon (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 463 days.

(21) Appl. No.: 14/733,266

(22) Filed: Jun. 8, 2015

(65) Prior Publication Data

US 2016/0189596 A1 Jun. 30, 2016

(30) Foreign Application Priority Data

Dec. 29, 2014 (KR) ..... 10-2014-0192156

(51) Int. Cl.
*G09G 3/20* (2006.01)
*G09G 3/36* (2006.01)

(52) U.S. Cl.
CPC ..... *G09G 3/2055* (2013.01); *G09G 3/2048* (2013.01); *G09G 3/3648* (2013.01); *G09G 3/3685* (2013.01); *G09G 2310/027* (2013.01); *G09G 2320/0242* (2013.01); *G09G 2320/0285* (2013.01)

(58) Field of Classification Search
CPC ... G09G 3/2055; G09G 3/2048; G09G 3/3648
USPC ..... 345/596, 690
See application file for complete search history.

(56) References Cited

U.S. PATENT DOCUMENTS 7,234,645 B2 * 6/2007 Silverbrook ..... B41J 2/14 235/454
2002/0005854 A1 * 1/2002 Deering ..... G06T 15/005 345/596
2003/0193451 A1 * 10/2003 Kimura ..... G09G 3/2022 345/60
2007/0176949 A1 * 8/2007 Chang ..... G09G 3/2048 345/690
2007/0192389 A1 8/2007 Chang et al.
(Continued)

FOREIGN PATENT DOCUMENTS

KR 100855988 B1 8/2008
KR 1020090032262 A 4/2009

OTHER PUBLICATIONS

European Search Report for European Patent Application No. 15187258.7 dated Apr. 13, 2016, citing the above reference(s).

*Primary Examiner* — Calvin C Ma
(74) *Attorney, Agent, or Firm* — Cantor Colburn LLP

(57) ABSTRACT

A timing controller includes a plurality of image enhancement blocks, a plurality of dithering blocks and a random number generating block. The plurality of image enhancement blocks performs image quality enhancement operations for input image data. The plurality of dithering blocks performs random dithering operations for outputs of the plurality of image enhancement blocks based on a plurality of random number tables. The random number generating block generates the plurality of random number tables which is provided to the plurality of dithering blocks.

20 Claims, 7 Drawing Sheets

(56) References Cited

U.S. PATENT DOCUMENTS

| | | | | |
|---|---|---|---|---|
| 2009/0128584 | A1* | 5/2009 | Lee | G09G 3/2055<br>345/690 |
| 2009/0251737 | A1* | 10/2009 | Silverbrook | B41J 2/14<br>358/296 |
| 2011/0091130 | A1 | 4/2011 | Faubert et al. | |
| 2013/0301740 | A1 | 11/2013 | Guo et al. | |

* cited by examiner

TIMING CONTROLLER AND DISPLAY APPARATUS INCLUDING THE SAME

This application claims priority to Korean Patent Application No. 10-2014-0192156, filed on Dec. 29, 2014, and all the benefits accruing therefrom under 35 U.S.C. § 119, the content of which in its entirety is herein incorporated by reference.

BACKGROUND

1. Field

Exemplary embodiments relate generally to a display apparatus, and more particularly to a timing controller of a display apparatus and a display apparatus including the timing controller.

2. Description of the Related Art

A liquid crystal display apparatus is a type of flat panel display ("FPD"), which is widely used in recent years. The FPD may include, but are not limited to, a liquid crystal display ("LCD"), a plasma display panel ("PDP") and an organic light emitting display ("OLED"), for example.

Typically, a display apparatus, e.g., an LCD apparatus, includes a display panel and a timing controller. The timing controller controls overall operations of the display panel. For example, the timing controller controls the display panel to display an image on the display panel. The timing controller further performs an image quality enhancement operation.

SUMMARY

Recently, a plurality of image quality enhancement operations are performed for one image, and a plurality of random dithering operations are performed. When the random dithering operations are performed for one image, dithering noise may occur, and thus the image quality may be degraded due to the dithering noise.

Exemplary embodiments of the invention relate to a timing controller that efficiently performs a plurality of image quality enhancement operations and a plurality of random dithering operations.

Exemplary embodiments of the invention relate to a display apparatus including the timing controller.

According to an exemplary embodiment, a timing controller includes a plurality of image enhancement blocks, a plurality of dithering blocks and a random number generating block. In such an embodiment, the plurality of image enhancement blocks performs image quality enhancement operations for input image data, the plurality of dithering blocks perform random dithering operations for outputs of the plurality of image enhancement blocks based on a plurality of random number tables, and the random number generating block generates the plurality of random number tables which is provided to the plurality of dithering blocks.

In an exemplary embodiment, the plurality of image enhancement blocks may include a first image enhancement block and a second image enhancement block, the plurality of dithering blocks may include a first dithering block and a second dithering block, and the plurality of random number tables may include a first random number table and a second random number table. In such an embodiment, the first image enhancement block may perform a first image quality enhancement operation for the input image data to generate first image data. In such an embodiment, the first dithering block may perform a first random dithering operation for the first image data based on the first random number table to generate first dithering data. In such an embodiment, the second image enhancement block may perform a second image quality enhancement operation for the first dithering data to generate second image data. In such an embodiment, the second dithering block may perform a second random dithering operation for the second image data based on the second random number table to generate second dithering data.

In an exemplary embodiment, each of a bit number of the first image data and a bit number of the second image data may be greater than a bit number of the input image data. In such an embodiment, each of a bit number of the first dithering data and a bit number of the second dithering data may be the same as the bit number of the input image data.

In an exemplary embodiment, the random number generating block may generate a plurality of horizontal random number groups and a plurality of vertical random number groups, and may combine the plurality of horizontal random number groups and the plurality of vertical random number groups to generate a random number table among the plurality of random number tables.

In an exemplary embodiment, the random number generating block may repeatedly perform a random number generation, a modular arithmetic and a loop operation to generate a horizontal random number group among the plurality of horizontal random number groups. In such an embodiment, an initial random number may be generated by the random number generation, a random number of the horizontal random number group may be generated by the modular arithmetic on the initial random number, and a duplicacy of the random number may be determined based on the loop operation.

In an exemplary embodiment, the horizontal random number group may include K numbers from zero through (K−1), where K is a natural number equal to or greater than two. In such an embodiment, the random number generation, the modular arithmetic and the loop operation may be repeatedly performed until the horizontal random number group includes all of the K numbers from zero through (K−1).

In an exemplary embodiment, the random number generating block may generate each of random numbers in the random number table by arranging the plurality of horizontal random number groups in a row, arranging the plurality of vertical random number groups in a column, adding a respective horizontal random number in the row to a respective vertical random number in the column, and performing a modular arithmetic on a sum of the respective horizontal random number and the respectively vertical random number.

In an exemplary embodiment, the plurality of random number tables may be periodically updated.

According to an exemplary embodiment, a display apparatus includes a display panel and a timing controller. In such an embodiment, the display panel includes a plurality of pixels and displays an image based on output image data. In such an embodiment, the timing controller controls an operation of the display panel and generates the output image data based on input image data. In such an embodiment, the timing controller includes a plurality of image enhancement blocks, a plurality of dithering blocks and a random number generating block. In such an embodiment, the plurality of image enhancement blocks perform image quality enhancement operations for the input image data, the plurality of dithering blocks perform random dithering operations for outputs of the plurality of image enhancement blocks based on a plurality of random number table, and the random number generating block generates the plurality of random number tables which is provided to the plurality of dithering blocks.

In an exemplary embodiment, the plurality of image enhancement blocks may include a first image enhancement block and a second image enhancement block, the plurality of dithering blocks may include a first dithering block and a second dithering block, and the plurality of random number tables may include a first random number table and a second random number table. In such an embodiment, the first image enhancement block may perform a first image quality enhancement operation for the input image data to generate first image data. In such an embodiment, the first dithering block may perform a first random dithering operation for the first image data based on the first random number table to generate first dithering data. In such an embodiment, the second image enhancement block may perform a second image quality enhancement operation for the first dithering data to generate second image data. In such an embodiment, the second dithering block may perform a second random dithering operation for the second image data based on the second random number table to generate the output image data.

In an exemplary embodiment, each of a bit number of the first image data and a bit number of the second image data may be greater than a bit number of the input image data. In such an embodiment, each of a bit number of the first dithering data and a bit number of the output image data may be the same as the bit number of the input image data.

In an exemplary embodiment, the random number generating block may generate a plurality of horizontal random number groups and a plurality of vertical random number groups, and may combine the plurality of horizontal random number groups and the plurality of vertical random number groups to generate a random number table among the plurality of random number tables.

In an exemplary embodiment, the random number generating block may repeatedly perform a random number generation, a modular arithmetic and a loop operation to generate a horizontal random number group among the plurality of horizontal random number groups. In such an embodiment, an initial random number may be generated by the random number generation, a random number of the horizontal random number group may be generated by the modular arithmetic on the initial random number, and a duplicacy of the random number may be determined based on the loop operation.

In an exemplary embodiment, the horizontal random number group may include K numbers from zero through (K−1), where K is a natural number equal to or greater than two. In such an embodiment, the random number generation, the modular arithmetic and the loop operation may be repeatedly performed until the horizontal random number group includes all of the K numbers from zero through (K−1).

In an exemplary embodiment, the random number generating block may generate each of random numbers in the random number table by arranging the plurality of horizontal random number groups in a row, arranging the plurality of vertical random number groups in a column, adding a respective horizontal random number in the row to a respective vertical random number in the column, and performing a modular arithmetic on a sum of the respective horizontal and vertical random numbers.

In an exemplary embodiment, the plurality of random number tables may be periodically updated In an exemplary embodiment, the display panel may be divided into a plurality of pixel groups, each of which includes at least two of the plurality of pixels. IN such an embodiment, each of a plurality of random numbers in the plurality of random number tables may correspond to a respective one of the plurality of pixel groups.

In an exemplary embodiment, each of the plurality of pixel groups may include four pixels arranged in a 2×2 matrix formation.

In an exemplary embodiment, the display apparatus may further include a gate driver and a data driver. In such an embodiment, the gate driver may generate gate signals to apply the gate signals to the display panel, and the data driver may generate data voltages based on the output image data to apply the data voltages to the display panel.

In an exemplary embodiment, the timing controller may further include a control signal generator. In such an embodiment, the control signal generator may generate a first control signal for the gate driver and a second control signal for the data driver based on an input control signal.

In exemplary embodiments of the invention, the random dithering operations may be independent and separate from each other, and a single random number generating block may generate the random number tables that are utilized for performing the random dithering operations. In such embodiment, the random number tables may be generated by performing two steps. Accordingly, the correlativity of random numbers included in the random number tables may be substantially reduced, and the random number tables may be independent from each other. Accordingly, in such embodiment, the dithering noise due to the repetition of the random dithering operations may be effectively prevented, and the plurality of image quality enhancement operations and the plurality of random dithering operations may be efficiently performed.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
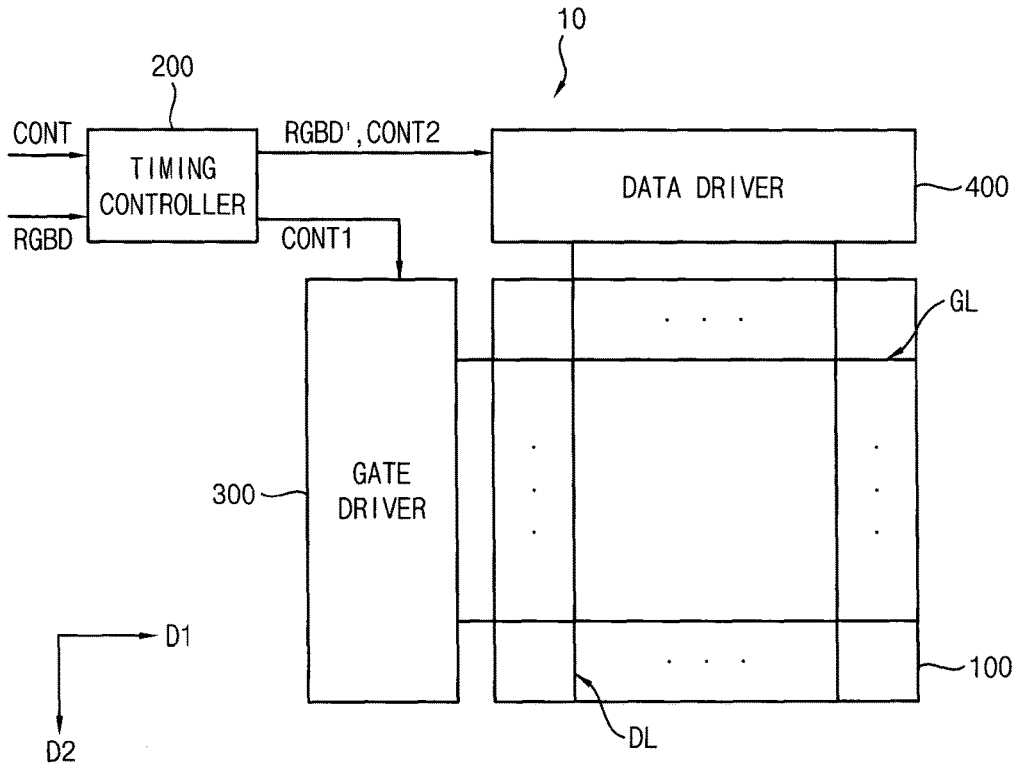
FIG. 1 is a block diagram illustrating an exemplary embodiment of a display apparatus according to the invention.

The invention now will be described more fully with reference to the accompanying drawings, in which various embodiments are shown. This invention may, however, be embodied in many different forms and should not be construed as limited to the embodiments set forth herein. Rather, these embodiments are provided so that this disclosure will be thorough and complete, and will fully convey the scope of the inventive concept to those skilled in the art. Like reference numerals refer to like elements throughout this application.

It will be understood that when an element is referred to as being "on" another element, it can be directly on the other element or intervening elements may be therebetween. In contrast, when an element is referred to as being "directly on" another element, there are no intervening elements present.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope thereof. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the inventive concept. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the invention will be described in detail with reference to the accompanying drawings.

FIG. 1 is a block diagram illustrating an exemplary embodiment of a display apparatus according to the invention.

Referring to FIG. 1, an exemplary embodiment of a display apparatus 10 includes a display panel 100, a timing controller 200, a gate driver 300 and a data driver 400.

The display panel 100 includes a plurality of gate lines GL connected to the gate driver 300 and a plurality of data lines DL connected to the data driver 400. The display panel 100 may display an image having a plurality of grayscales based on output image data RGBD'. The gate lines GL may extend substantially in a first direction D1, and the data lines DL may extend substantially in a second direction D2 crossing (e.g., substantially perpendicular to) the first direction D1.

The display panel 100 may include a plurality of pixels (e.g., pixels P in FIG. 5) that are arranged substantially in a matrix form. Each pixel may be electrically connected to a corresponding gate line of the gate lines GL and a corresponding data line of the data lines DL.

Each pixel may include a switching element (not illustrated), a liquid crystal capacitor (not illustrated) and a storage capacitor (not illustrated). The liquid crystal capacitor and the storage capacitor may be electrically connected to the switching element. In one exemplary embodiment, for example, the switching element may be a thin film transistor. The liquid crystal capacitor may include a first electrode connected to a pixel electrode and a second electrode connected to a common electrode. A data voltage may be applied to the first electrode of the liquid crystal capacitor. A common voltage may be applied to the second electrode of the liquid crystal capacitor. The storage capacitor may include a first electrode connected to the pixel electrode and a second electrode connected to a storage electrode. The data voltage may be applied to the first electrode of the storage capacitor. A storage voltage may be applied to the second electrode of the storage capacitor. The storage voltage may be substantially equal to the common voltage.

Each pixel may have a rectangular shape. In one exemplary embodiment, for example, each pixel may have a relatively short side in the first direction D1 and a relatively long side in the second direction D2. The relatively short side of each pixel may be substantially parallel to the gate lines GL. The relatively long side of each pixel may be substantially parallel to the data lines DL.

The timing controller 200 controls an operation of the display panel 100, and controls operations of the gate driver 300 and the data driver 400. The timing controller 200 receives input image data RGBD and an input control signal CONT from an external device (e.g., a host). The input image data RGBD may include a plurality of input pixel data for the plurality of pixels. Each input pixel data may include red grayscale data R, green grayscale data G and blue grayscale data B for a respective one of the plurality of pixels. The input control signal CONT may include a master clock signal, a data enable signal, a vertical synchronization signal, a horizontal synchronization signal, etc.

The timing controller 200 generates the output image data RGBD', a first control signal CONT1 and a second control signal CONT2 based on the input image data RGBD and the input control signal CONT.

In one exemplary embodiment, for example, the timing controller 200 may generate the output image data RGBD' based on the input image data RGBD. The output image data RGBD' may be provided to the data driver 400. In some exemplary embodiments, the output image data RGBD' may be image data that is substantially the same as the input image data RGBD. In other exemplary embodiments, the output image data RGBD' may be compensated image data that is generated by compensating the input image data RGBD. In such an embodiment, the output image data RGBD' may include a plurality of output pixel data for the plurality of pixels.

The timing controller 200 may generate the first control signal CONT1 based on the input control signal CONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 may generate the second control signal CONT2 based on the input control signal CONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, etc.

In an exemplary embodiment, the timing controller 200 performs image quality enhancement operations for the input image data RGBD, performs random dithering operations for results of the image quality enhancement operations, and generates a plurality of random number tables utilized for performing the random dithering operations. Such configurations and operations of the timing controller 200 will be described below in greater detail with reference to FIGS. 2 through 8.

The gate driver 300 receives the first control signal CONT1 from the timing controller 200. The gate driver 300 generates a plurality of gate signals for driving the gate lines GL based on the first control signal CONT1. The gate driver 300 may sequentially apply the plurality of gate signals to the gate lines GL.

The data driver 400 receives the second control signal CONT2 and the output image data RGBD' from the timing controller 200. The data driver 400 generates a plurality of data voltages (e.g., analog data voltages) based on the second control signal CONT2 and the output image data RGBD' (e.g., digital image data). The data driver 400 may apply the plurality of data voltages to the data lines DL.

In some exemplary embodiments, the data driver 400 may include a shift register (not illustrated), a latch (not illustrated), a signal processor (not illustrated) and a buffer (not illustrated). The shift register may output a latch pulse to the latch. The latch may temporarily store the output image data RGBD', and may output the output image data RGBD' to the signal processor. The signal processor may generate the analog data voltages based on the digital output image data RGBD', and may output the analog data voltages to the buffer. The buffer may output the analog data voltages to the data lines DL.

In some exemplary embodiments, the gate driver 300 and/or the data driver 400 may be disposed, e.g., directly mounted, on the display panel 100, or may be connected to the display panel 100 in a tape carrier package ("TCP") type. Alternatively, the gate driver 300 and/or the data driver 400 may be integrated circuits provided on the display panel 100.

Figure 2:
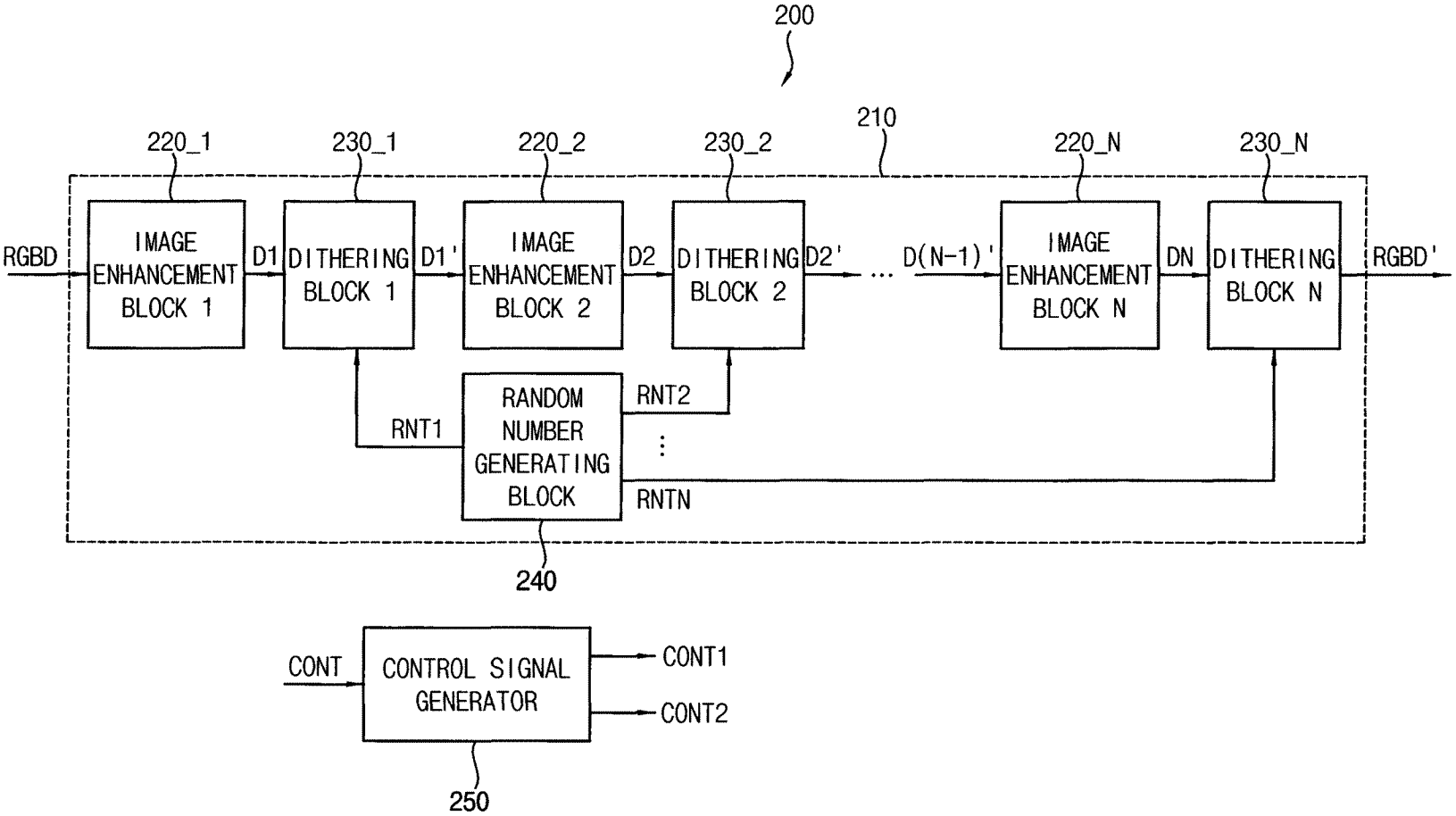
FIG. 2 is a block diagram illustrating a an exemplary embodiment of timing controller according to the invention.

FIG. 2 is a block diagram illustrating an exemplary embodiment of a timing controller according to the invention.

Referring to FIG. 2, a timing controller 200 includes an image processor 210. The timing controller 200 may further include a control signal generator 250. The timing controller 200 is illustrated in FIG. 2 as being divided into two elements for convenience of illustration, however, the timing controller 200 may not be physically divided.

The image processor 210 performs the image quality enhancement operations for the input image data RGBD and the random dithering operations for the results of the image quality enhancement operations to generate the output image data RGBD'. The image processor 210 includes a plurality of image enhancement blocks, a plurality of dithering blocks and a random number generating block 240.

The plurality of image enhancement blocks performs the image quality enhancement operations for the input image data RGBD. In one exemplary embodiment, for example, the image quality enhancement operations may include an image quality compensation, a spot compensation, an adaptive color correction ("ACC") and/or a dynamic capacitance compensation ("DCC") for the input image data RGBD. Each image enhancement block may perform a respective one of the image quality enhancement operations.

The plurality of dithering blocks performs the random dithering operations for outputs of the plurality of image enhancement blocks based on a plurality of random number tables. The random number generating block 240 generates the plurality of random number tables that are utilized by the plurality of dithering blocks. In an exemplary embodiment of the timing controller 200, more than two random dithering operations may be performed. Each of the random dithering operations may be individually and independently performed based on a respective one of different random number tables.

In some exemplary embodiments, the plurality of image enhancement blocks may include first through N-th image enhancement blocks 220_1, 220_2, . . . , 220_N, where N is a natural number equal to or greater than two. The plurality of dithering blocks may include first through N-th dithering blocks 230_1, 230_2, . . . , 230_N. The plurality of random number tables may include first through N-th random number tables RNT1, RNT2, . . . , RNTN.

In some exemplary embodiments, the image quality enhancement operations and the random dithering operations may be alternately and sequentially performed. In one exemplary embodiment, for example, the first image enhancement block 220_1 may perform a first image quality enhancement operation for the input image data RGBD to generate first image data D1. The first dithering block 230_1 may perform a first random dithering operation for the first image data D1 based on the first random number table RNT1 to generate first dithering data D1'. The second image enhancement block 220_2 may perform a second image quality enhancement operation for the first dithering data D1' to generate second image data D2. The second dithering block 230_2 may perform a second random dithering operation for the second image data D2 based on the second random number table RNT2 to generate second dithering data D2'. The N-th image enhancement block 220_N may perform an N-th image quality enhancement operation for (N−1)-th dithering data D(N−1)' to generate N-th image data DN. The N-th dithering block 230_N may perform a N-th random dithering operation for the N-th image data DN based on the N-th random number table RNTN to generate N-th dithering data (e.g., the output image data RGBD').

In some exemplary embodiments, a bit number of the first image data D1, a bit number of the second image data D2 and a bit number of the N-th image data DN may be greater than a bit number of the input image data RGBD, respectively. A bit number of the first dithering data D1', a bit number of the second dithering data D2' and a bit number of the N-th dithering data (e.g., the output image data RGBD') may be substantially the same as the bit number of the input image data RGBD, respectively. In such an embodiment, a bit number of image data may be increased by the image quality enhancement operations and may be decreased by the random dithering operations. In one exemplary embodiment, For example, when the input image data RGBD is 10-bit RGB data, each of the first through N-th image data D1, D2, . . . , DN may be 12-bit or 14-bit RGB data, and each of the first through N-th dithering data D1', D2', . . . , RGBD' may be 10-bit RGB data.

In some exemplary embodiments, each of the plurality of dithering blocks may obtain a dither table based on a respective one of the plurality of random number tables, and may perform the random dithering operation based on the obtained dither table. In the display field, the random dithering operation has been widely used for improving image fidelity of a digital display and/or for providing digital displays with greater image fidelity, and thus detailed descriptions of the random dithering operation will be omitted.

The random number generating block 240 may generate a plurality of horizontal random number groups and a plurality of vertical random number groups, and may combine the plurality of horizontal random number groups and the plurality of vertical random number groups to generate the plurality of random number tables. Configurations and operations of the random number generating block 240 will be described below in greater detail with reference to FIGS. 3 through 8.

In some exemplary embodiments, the plurality of random number tables may be periodically updated. In one exemplary embodiment, for example, the plurality of random number tables may be updated at predetermined image frames (e.g., every four image frames).

In some exemplary embodiments, the random number generating block 240 may include a micro controller unit ("MCU"). In such an embodiment, the random number generating block 240 may be a software-based random number generator. In other exemplary embodiments, the random number generating block 240 may include a linear feedback shift register ("LFSR"). In such an embodiment, the random number generating block 240 may be a hardware-based random number generator.

The control signal generator 230 may receive the input control signal CONT from the external device, and may generate the first control signal CONT1 for the gate driver 300 and the second control signal CONT2 for the data driver 400 based on the input control signal CONT, as shown in FIG. 1. The control signal generator 230 may output the first control signal CONT1 to the gate driver 300 and may output the second control signal CONT2 to the data driver 400, as shown in FIG. 1.

In an exemplary embodiment, the timing controller 200 may perform the image quality enhancement operations and the random dithering operations. In an exemplary embodiment of the timing controller 200, the random dithering operations may be independent and separate from each other, and a single random number generating block 240 may generate the random number tables RNT1, RNT2, . . . , RNTN that are utilized for performing the random dithering operations. Accordingly, the correlativity of random numbers included in the random number tables RNT1, RNT2, . . . , RNTN may be reduced, and dithering noise due to the repetition of the random dithering operations may be effectively prevented.

Figure 3:
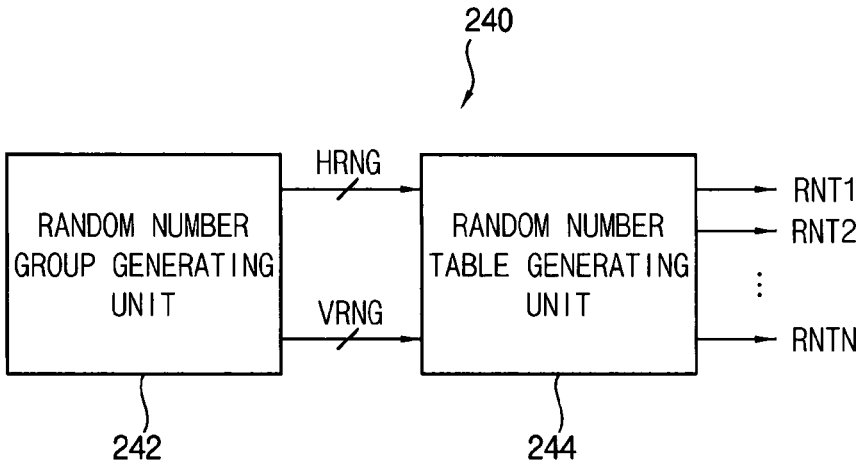
FIG. 3 is a block diagram illustrating an exemplary embodiment of a random number generating block included in the timing controller of FIG. 2.

FIG. 3 is a block diagram illustrating an exemplary embodiment of a random number generating block included in the timing controller of FIG. 2.

Referring to FIG. 3, the random number generating block 240 may include a random number group generating unit 242 and a random number table generating unit 244.

The random number group generating unit 242 may generate a plurality of random number groups. In one exemplary embodiment, for example, the random number group generating unit 242 may generate a plurality of horizontal random number groups HRNG and a plurality of vertical random number groups VRNG.

In an exemplary embodiment, each random number group may be generated by repeatedly performing a random number generation, a modular arithmetic and a loop operation. In such an embodiment, an initial random number may be generated by the random number generation, a first random number may be generated by the modular arithmetic on the initial random number, and it may be determined based on the loop operation whether the first random number is duplicately generated. Operation of generating each random number group will be described below in greater detail with reference to FIG. 6.

In an exemplary embodiment, each random number group may include K numbers from zero through (K−1), where K is a natural number equal to or greater than two. In one exemplary embodiment, for example, if K is about 10, each random number group may include 10 numbers from zero through nine. In such an embodiment, the K numbers in each random number group may be arranged in an order of the generation. Since the K numbers in each random number group are randomly generated, an order of arrangement of K numbers in one random number group may be generally different from an order of arrangement of K numbers in another random number group.

In such an embodiment, the random number table generating unit 244 may combine the plurality of random number groups (e.g., the plurality of horizontal random number groups and the plurality of vertical random number groups) to generate the plurality of random number tables RNT1, RNT2, . . . , RNTN. Operation of generating each random number table will be described below in greater detail with reference to FIGS. 7 and 8.

Figure 4:
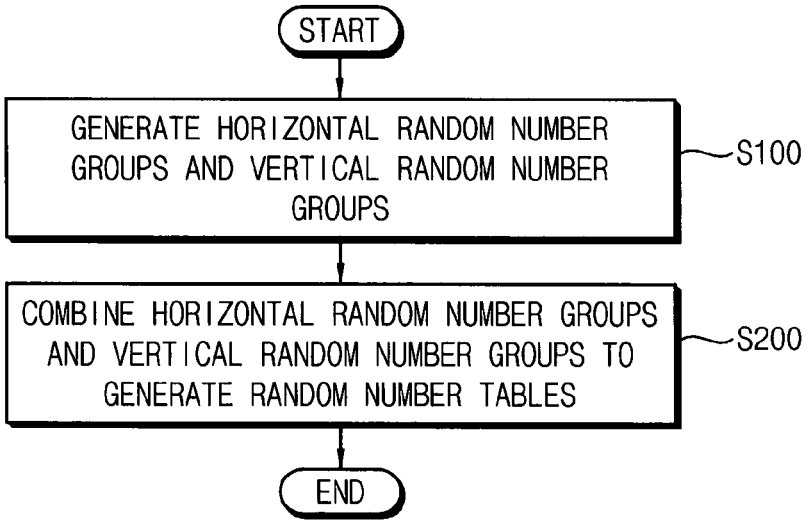
FIG. 4 is a flow chart illustrating an operation of an exemplary embodiment of the random number generating block included in the timing controller of FIG. 2.

FIG. 4 is a flow chart illustrating an operation of an exemplary embodiment of the random number generating block included in the timing controller of FIG. 2.

Referring to FIGS. 2, 3 and 4, the random number generating block 240 may generate the plurality of horizontal random number groups HRNG and the plurality of vertical random number groups VRNG (S100). The random number generating block 240 may combine the plurality of horizontal random number groups HRNG and the plurality of vertical random number groups VRNG to generate the plurality of random number tables RNT1, RNT2, . . . , RNTN (S200). Such operations of the random number generating block 240 (S100 and S200) may be performed by the random number group generating unit 242 and the random number table generating unit 244, respectively.

In an exemplary embodiment, the timing controller 200 may generate, by performing operations of S100 and S200, the plurality of random number tables RNT1, RNT2, . . . , RNTN each of which corresponds to the whole area of the display panel 100 in FIG. 1. Accordingly, the random number tables RNT1, RNT2, . . . , RNTN may be independent from each other, and the results of the operations of the dithering blocks 230*a*, 230*b*, . . . , 230*n* based on the random number tables RNT1, RNT2, . . . , RNTN may have a relatively improved randomness.

Figure 5:
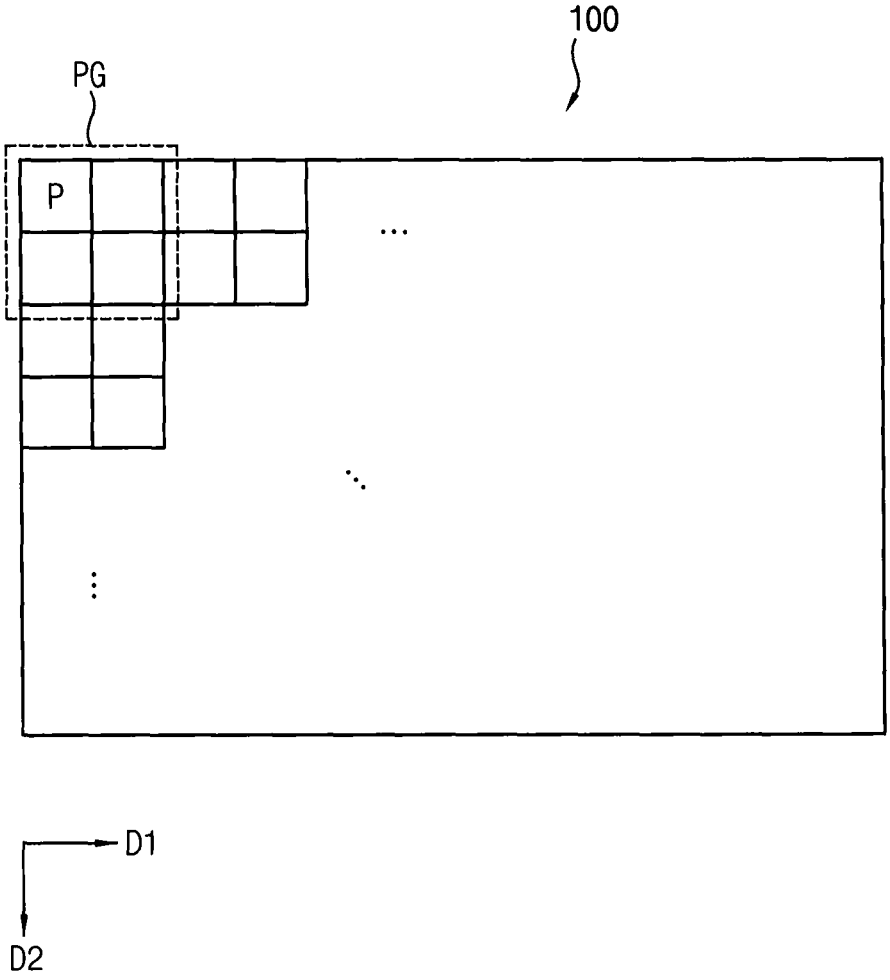
FIG. 5 is a diagram illustrating an exemplary embodiment of a display panel in the display apparatus of FIG. 1.

FIG. 5 is a diagram illustrating an exemplary embodiment of a display panel included in the display apparatus of FIG. 1.

Referring to FIG. 5, the display panel 100 may include a plurality of pixels P. As described above with reference to FIG. 1, each of the plurality of pixels P may be electrically connected to a respective one of the gate lines GL and a respective one of the data lines DL. In some exemplary embodiments, each of the plurality of pixels P may include at least two subpixels.

In an exemplary embodiment, the display panel 100 may be divided into a plurality of pixel groups PG to perform the random dithering operations. Each of the plurality of pixel groups PG may include at least two of the plurality of pixels P. In one exemplary embodiment, for example, as illustrated in FIG. 5, each of the plurality of pixel groups PG may include four pixels arranged in a 2×2 matrix formation. However, a configuration of each pixel group may not be limited thereto and may be variously changed.

In some exemplary embodiments, the number of random numbers included in one random number group may be determined based on a configuration of each pixel group. In one exemplary embodiment, for example, where each of the plurality of pixel groups PG includes four pixels arranged in a 2×2 matrix formation, the number of random numbers included in one random number group may be about 24 because the number of possible arrangements of four pixels is about 24. In such an embodiment, one random number group may include 24 numbers from zero through twenty-three, for example.

In some exemplary embodiments, the number of random numbers included in one random number table and the number of random number groups used for generating one random number table may be determined based on a resolution of the display panel 100 (e.g., the number of the pixels P included in the display panel 100) and a configuration of each pixel group. In one exemplary embodiment, for example, where the display panel 100 includes about 3840×2160 pixels (e.g., if about 3840 pixels are arranged in the first direction D1 and about 2160 pixels are arranged in the second direction D2), and where each of the plurality of pixel groups PG includes four pixels arranged in a 2×2 matrix formation, the display panel 100 may be divided into about 1920×1080 pixel groups. In an exemplary embodiment, as described above, when each of the plurality of pixel groups PG includes four pixels arranged in a 2×2 matrix formation, the number of the random numbers included in one random number group may be about 24. Thus, in such an embodiment, about 80×45 random number groups may be defined to generate one random number table.

In such an embodiment, where the display panel 100 includes about 3840×2160 pixels, and where each of the plurality of pixel groups PG includes four pixels arranged in a 2×2 matrix formation, about 80 horizontal random number groups and about 45 vertical random number groups may be used to generate one random number table, and one random number table may include about 1920×1080 random numbers.

Hereinafter, exemplary embodiments where the display panel includes about 3840×2160 pixels and is divided into about 1920×1080 pixel groups, each of which includes four pixels arranged in a 2×2 matrix formation, will be described in greater detail.

Figure 6:
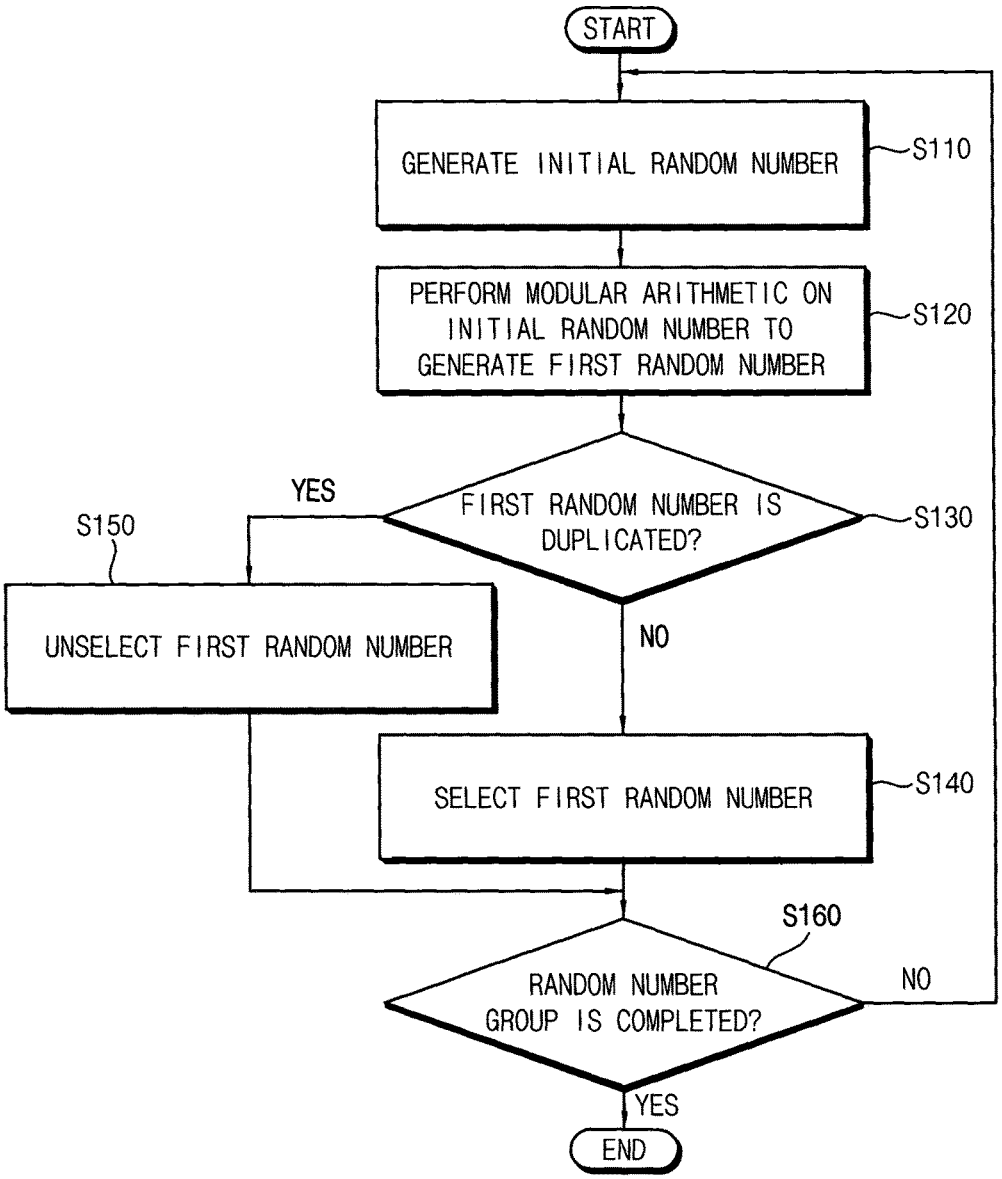
FIG. 6 is a flow chart showing an exemplary embodiment of generating a plurality of horizontal and vertical random number groups in FIG. 4.

FIG. 6 is a flow chart for describing an exemplary embodiment of generating a plurality of horizontal and vertical random number groups in FIG. 4. For convenience of description, an operation of generating one random number group will be described in detail with reference to FIG. 6.

Referring to FIG. 6, to generate a first horizontal random number group among the plurality of horizontal and vertical random number groups HRNG and VRNG in FIG. 3, an initial random number may be generated by the random number generation (S110). In one exemplary embodiment, for example, the initial random number may be generated based on a software random function and may be a 64-bit random number.

A random number, e.g., a first random number, may be generated by the modular arithmetic on the initial random number (S120). The modular arithmetic may be referred to as a remainder operation and may indicate an operation of obtaining a remainder of the division of a number A by a number B. In one exemplary embodiment, for example, when one random number group includes K (e.g., about 24) numbers from zero through (K−1), the first random number may correspond to a remainder of the division of the initial random number by K.

In such an embodiment, a duplicacy of the first random number may be determined based on the loop operation, that is, it may be determined based on the loop operation whether the first random number is duplicately generated. When the first random number is already included in the first horizontal random number group because the same random number is previously generated, e.g., when there is a duplicacy of the first random number or the first random number is duplicated (S130: YES), the first random number may be unselected as an element of the first horizontal random number group (S150). When the first random number is not included in the first horizontal random number group because the same random number is not previously generated, e.g., when there is no duplicacy of the first random number or the first random number is not duplicated (S130: NO), the first random number may be selected as an element of the first horizontal random number group (S140).

The random number generation (S110), the modular arithmetic (S120) and the loop operation (S130, S140 and S150) may be repeatedly performed until the first horizontal random number group includes all of the K numbers from zero through (K−1). When the first horizontal random number group does not include all of the K numbers from zero through (K−1), e.g., when the first horizontal random number group is not completed (S160: NO), the processes or operations described above S110, S120, S130, S140 and S150 may be repeated. In one exemplary embodiment, for example, another initial random number may be generated, a second random number may be generated based on the another initial random number, and the second random number may be selectively included in the first horizontal random number group based on such determination. When the first horizontal random number group includes all of the K numbers from zero through (K−1), e.g., when the first horizontal random number group is completed (S160: YES), the operation of generating the first horizontal random number group may be terminated.

After the first horizontal random number group is completely generated, the plurality of horizontal random number groups HRNG other than the first horizontal random number group may be sequentially generated. After the plurality of horizontal random number groups HRNG are completely generated, the plurality of vertical random number groups VRNG may be sequentially generated.

Figure 7:
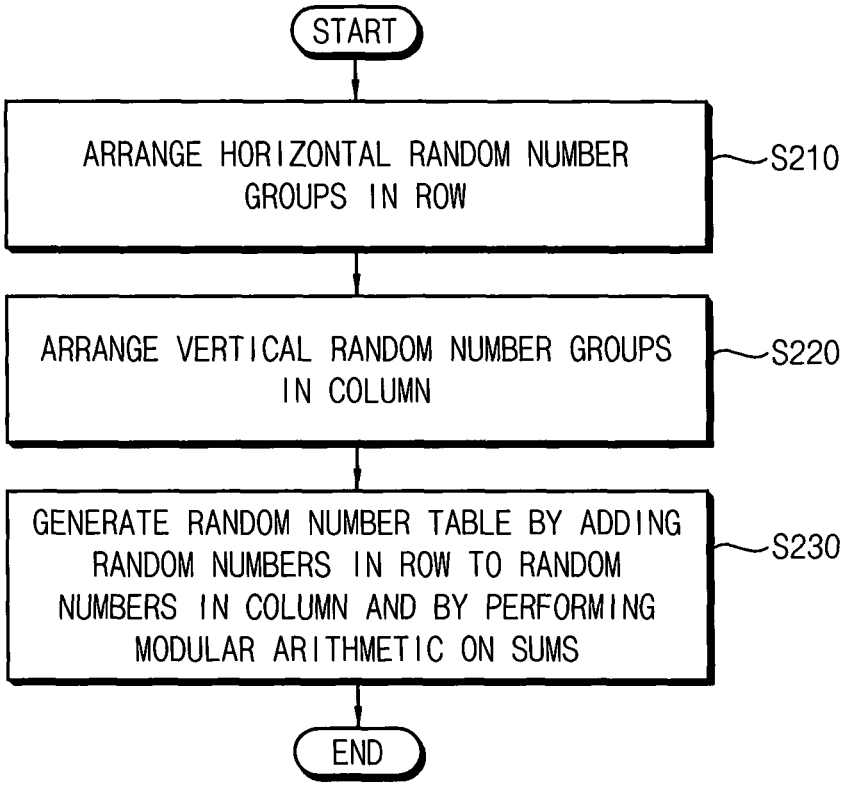
FIGS. 7 and 8 are diagrams showing an exemplary embodiment of generating a plurality of random number tables in FIG. 4.
Figure 8:
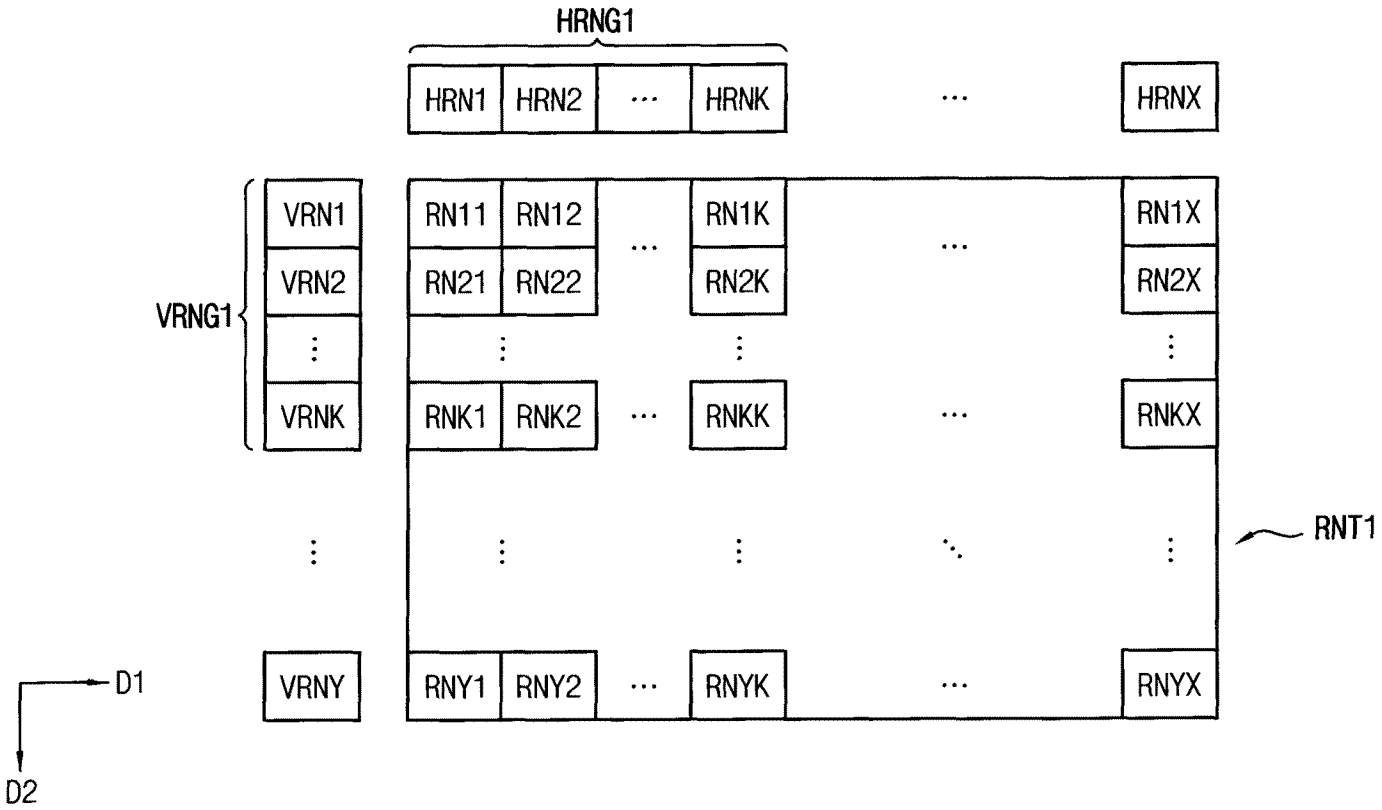

FIGS. 7 and 8 are diagrams showing an exemplary embodiment of generating a plurality of random number tables in FIG. 4. For convenience of description, an operation of generating one random number table will be described with reference to FIGS. 7 and 8.

Referring to FIGS. 7 and 8, to generate a random number table, e.g., the first random number table RNT1, among the plurality of random number tables RNT1, RNT2, . . . , RNTN, the plurality of horizontal random number groups HRNG in FIG. 3 may be arranged in a row or in a row direction of the random number table (S210). In one exemplary embodiment, for example, (X/K) (e.g., about 80) horizontal random number groups including a first horizontal random number group HRNG1 may be arranged along the first direction D1, and thus X (e.g., about 1920) horizontal random numbers HRN1, HRN2, . . . , HRNK, . . . , HRNX may be arranged along the first direction D1.

The plurality of vertical random number groups VRNG in FIG. 3 may be arranged in a column or in a column direction of the random number table (S220). In one exemplary embodiment, for example, (Y/K) (e.g., about 45) vertical random number groups including a first vertical random number group VRNG1 may be arranged along the second direction D2, and thus Y (e.g., about 1080) vertical random numbers VRN1, VRN2, . . . , VRNK, . . . , VRNY may be arranged along the second direction D2.

In an exemplary embodiment, each of random numbers RN11, RN12, RN1K, RN1X, RN21, RN22, RN2K, RN2X, RNK1, RNK2, RNKK, RNKX, RNY1, RNY2, RNYK, RNYX in the first random number table RNT1 may be generated by adding a respective one of random numbers HRN1, . . . , HRNX in the row to a respective one of random numbers VRN1, . . . , VRNY in the column, and by performing the modular arithmetic on a sum of the respective one of the random numbers HRN1, . . . , HRNX and the respective one of the random numbers VRN1, . . . , VRNY (S230). In such an embodiment, the first random number table RNT1 including X×Y random numbers may be generated based on X random numbers in the first row and Y random numbers in the first column. In one exemplary embodiment, for example, a first sum may be obtained by adding the random number HRN1 to the random number VRN1, the random number RN11 in the first random number table RNT1 may be generated by obtaining a remainder of the division of the first sum by K (e.g., about 24).

In such an embodiment, the random number RN11 may be substantially the same as a value of shifting the random number HRN1 by VRN1, the random number RN12 may be substantially the same as a value of shifting the random number HRN2 by VRN1, and the random number RN1K may be substantially the same as a value of shifting the random number HRNK by VRN1. Thus, the random numbers RN11, RN12, . . . , RN1K may also include K numbers from zero through (K−1).

After the first random number table RNT1 is completely generated, the second through N-th random number tables RNT2, . . . , RNTN may be sequentially generated.

In some exemplary embodiments, each of the random numbers RN11, . . . , RNYX in the first random number table RNT1 may correspond to a respective one of the plurality of pixel groups PG in FIG. 5. Similarly, each of the random numbers in the second through N-th random number table RNT2, . . . , RNTN may correspond to the respective one of the plurality of pixel groups PG in FIG. 5, respectively.

In an exemplary embodiment of the display apparatus 10, the random dithering operations in the timing controller 200 may be independent and separate from each other, and a single random number generating block 240 may generate the random number tables RNT1, RNT2, . . . , RNTN that are utilized for performing the random dithering operations. In such an embodiment, the random number tables RNT1, RNT2, . . . , RNTN may be generated by performing two processes S100 and S200. Accordingly, the correlativity of random numbers included in the random number tables RNT1, RNT2, . . . , RNTN may be reduced, and the random number tables RNT1, RNT2, . . . , RNTN may be independent from each other. The dithering noise due to the repetition of the random dithering operations may be effectively prevented, and the plurality of image quality enhancement operations and the plurality of random dithering operations may be efficiently performed.

Although some exemplary embodiments where the display panel has a specific pixel group (e.g., 2×2 pixel group) and a specific size (e.g., 3840×2160) have been described herein, the invention is not limited thereto. In an alternative exemplary embodiment, the display panel may have various pixel groups and various sizes.

Exemplary embodiments described herein may be used in a display apparatus and/or a system including the display apparatus, such as a mobile phone, a smart phone, a personal digital assistants ("PDA"), a portable multimedia player ("PMP"), a digital camera, a digital television, a set-top box, a music player, a portable game console, a navigation device, a personal computer ("PC"), a server computer, a workstation, a tablet computer, a laptop computer, a smart card, a printer, etc., but not being limited thereto.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A timing controller comprising:

a plurality of image enhancement blocks which performs image quality enhancement operations for input image data;

a plurality of dithering blocks which performs random dithering operations for outputs of the plurality of image enhancement blocks based on a plurality of random number tables; and a random number generating block which generates the plurality of random number tables which are provided to the plurality of dithering blocks, wherein the image quality enhancement operations and the random dithering operations are alternately and sequentially performed.

2. The timing controller of claim 1, wherein the plurality of image enhancement blocks comprises a first image enhancement block and a second image enhancement block, the plurality of dithering blocks comprises a first dithering block and a second dithering block, and the plurality of random number tables comprises a first random number table and a second random number table, wherein the first image enhancement block performs a first image quality enhancement operation for the input image data to generate first image data, wherein the first dithering block performs a first random dithering operation for the first image data based on the first random number table to generate first dithering data, wherein the second image enhancement block performs a second image quality enhancement operation for the first dithering data to generate second image data, and wherein the second dithering block performs a second random dithering operation for the second image data based on the second random number table to generate second dithering data.

3. The timing controller of claim 2, wherein each of a bit number of the first image data and a bit number of the second image data is greater than a bit number of the input image data, and each of a bit number of the first dithering data and a bit number of the second dithering data is the same as the bit number of the input image data.

4. The timing controller of claim 1, wherein the random number generating block generate a plurality of horizontal random number groups and a plurality of vertical random number groups, and the random number generating block combine the plurality of horizontal random number groups and the plurality of vertical random number groups to generate a random number table among the plurality of random number tables.

5. The timing controller of claim 4, wherein the random number generating block repeatedly performs a random number generation, a modular arithmetic and a loop operation to generate a horizontal random number group among the plurality of horizontal random number groups, wherein an initial random number is generated by the random number generation, wherein a random number of the horizontal random number group is generated by the modular arithmetic on the initial random number, and wherein a duplicacy of the random number is determined based on the loop operation.

6. The timing controller of claim 5, wherein the horizontal random number group includes K numbers from zero through (K−1), wherein K is a natural number equal to or greater than two, and the random number generation, the modular arithmetic and the loop operation are repeatedly performed until the horizontal random number group includes all of the K numbers from zero through (K−1).

7. The timing controller of claim 4, wherein the random number generating block generates each of random numbers in the random number table by arranging the plurality of horizontal random number groups in a row, arranging the plurality of vertical random number groups in a column, adding a respective horizontal random number in the row to a respective vertical random number in the column, and performing a modular arithmetic on a sum of the respective horizontal random number and the respective vertical random number.

8. The timing controller of claim 1, wherein the plurality of random number tables are periodically updated.

9. A display apparatus comprising:

a display panel comprising a plurality of pixels, wherein the display panel which displays an image based on output image data; and a timing controller which controls an operation of the display panel and generates the output image data based on input image data, wherein the timing controller comprises:

a plurality of image enhancement blocks which performs image quality enhancement operations for the input image data;

a plurality of dithering blocks which performs random dithering operations for outputs of the plurality of image enhancement blocks based on a plurality of random number tables; and a random number generating block which generates the plurality of random number tables which is provided to the plurality of dithering blocks, wherein the image quality enhancement operations and the random dithering operations are alternately and sequentially performed.

10. The display apparatus of claim 9, wherein the plurality of image enhancement blocks comprises a first image enhancement block and a second image enhancement block, the plurality of dithering blocks comprises a first dithering block and a second dithering block, and the plurality of random number tables comprises a first random number table and a second random number table, wherein the first image enhancement block performs a first image quality enhancement operation for the input image data to generate first image data, wherein the first dithering block performs a first random dithering operation for the first image data based on the first random number table to generate first dithering data, wherein the second image enhancement block performs a second image quality enhancement operation for the first dithering data to generate second image data, and wherein the second dithering block performs a second random dithering operation for the second image data based on the second random number table to generate the output image data.

11. The display apparatus of claim 10, wherein each of a bit number of the first image data and a bit number of the second image data is greater than a bit number of the input image data, and each of a bit number of the first dithering data and a bit number of the output image data is the same as the bit number of the input image data, respectively.

12. The display apparatus of claim 10, wherein the random number generating block generates a plurality of horizontal random number groups and a plurality of vertical random number groups, and the random number generating block combines the plurality of horizontal random number groups and the plurality of vertical random number groups to generate a random number table among the plurality of random number tables.

13. The display apparatus of claim 12, wherein the random number generating block repeatedly performs a random number generation, a modular arithmetic and a loop operation to generate a horizontal random number group among the plurality of horizontal random number groups, wherein an initial random number is generated by the random number generation, wherein a random number of the horizontal random number group is generated by the modular arithmetic on the initial random number, and wherein a duplicacy of the random number is determined based on the loop operation.

14. The display apparatus of claim 13, wherein the horizontal random number group includes K numbers from zero through (K−1), wherein K is a natural number equal to or greater than two, wherein the random number generation, the modular arithmetic and the loop operation are repeatedly performed until the horizontal random number group includes all of the K numbers from zero through (K−1).

15. The display apparatus of claim 12, wherein the random number generating block generates each of random numbers in the random number table by arranging the plurality of horizontal random number groups in a row, arranging the plurality of vertical random number groups in a column, adding a respective horizontal random number in the row to a respective vertical random number in the column, and performing a modular arithmetic on a sum of the respective horizontal random number and the respective vertical random number.

16. The display apparatus of claim 9, wherein the plurality of random number tables are periodically updated.

17. The display apparatus of claim 9, wherein the display panel is divided into a plurality of pixel groups, each of which includes at least two of the plurality of pixels, wherein each of a plurality of random numbers in the plurality of random number tables corresponds to a respective one of the plurality of pixel groups.

18. The display apparatus of claim 17, wherein each of the plurality of pixel groups includes four pixels arranged in a 2×2 matrix formation.

19. The display apparatus of claim 9, further comprising:

a gate driver which generates gate signals to apply the gate signals to the display panel; and a data driver which generates data voltages based on the output image data to apply the data voltages to the display panel.

20. The display apparatus of claim 19, wherein the timing controller further comprises:

a control signal generator which generates a first control signal for the gate driver and a second control signal for the data driver based on an input control signal.

* * * * *